US011479940B2

(12) United States Patent
Kaufman

(10) Patent No.: US 11,479,940 B2
(45) **Date of Patent: *Oct. 25, 2022**

(54) APPARATUS AND METHOD FOR LIFTING BUILDING FOUNDATIONS

(71) Applicant: Kevin Kaufman, Des Peres, MO (US)

(72) Inventor: Kevin Kaufman, Des Peres, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/855,296

(22) Filed: Apr. 22, 2020

(65) Prior Publication Data

US 2020/0248428 A1 Aug. 6, 2020

Related U.S. Application Data

(63) Continuation of application No. 12/783,303, filed on May 19, 2010, now Pat. No. 10,662,608, which is a continuation of application No. 11/623,154, filed on Jan. 15, 2007, now Pat. No. 7,744,316.

(51) Int. Cl.
*E02D 35/00* (2006.01)

(52) U.S. Cl.
CPC ..... *E02D 35/00* (2013.01); *E02D 35/005* (2013.01)

(58) Field of Classification Search
CPC .. E02D 5/526; E02D 5/56; E02D 5/80; E02D 5/801; E02D 7/22; E02D 35/00; E02D 35/005
USPC ..... 405/230
See application file for complete search history.

(56) References Cited

U.S. PATENT DOCUMENTS 2,260,811 A * 10/1941 Kozak ..... B65G 33/32 403/19
4,239,419 A * 12/1980 Gillen, Jr. ..... E02D 5/523 405/232
4,678,373 A * 7/1987 Langenbach, Jr. ..... E02D 27/48 405/230
5,145,291 A * 9/1992 Bullivant ..... E02D 5/38 405/230
6,682,267 B1 * 1/2004 Jones ..... E02D 5/523 405/230
6,817,810 B2 * 11/2004 Jones ..... E02D 5/523 405/230
6,942,430 B1 * 9/2005 Suver ..... E02D 5/56 405/232
7,097,388 B1 * 8/2006 Mansour ..... E02D 27/48 405/230
7,220,081 B1 * 5/2007 Gantt, Jr. ..... E02D 27/12 405/230
7,314,335 B2 * 1/2008 Whitsett ..... E02D 5/38 405/233

(Continued)

*Primary Examiner* — Frederick L Lagman
(74) *Attorney, Agent, or Firm* — Armstrong Teasdale LLP

(57) ABSTRACT

A lift bracket system for lifting a building structure such as a foundation and the like comprising a lift plate having a top surface and a bottom surface, the top surface for insertion under the building structure; a generally cylindrical housing affixed to the lift plate and extending perpendicularly from the top surface and the bottom surface of the lift plate, the housing defining a generally circular opening through the lift plate, the opening being disposed away from the center of the lift plate; and at least one gusset for supporting the lift plate, the gusset having a first end and a second end, the gusset disposed beneath the lift plate, wherein the first end of the gusset is attached to the bottom surface of the lift plate and the second end of the gusset is attached to the housing.

20 Claims, 12 Drawing Sheets

(56) References Cited

U.S. PATENT DOCUMENTS

| | | | | |
|---|---|---|---|---|
| 7,416,367 | B2 * | 8/2008 | St. Onge | E02D 5/74 405/229 |
| 7,470,090 | B2 * | 12/2008 | Heppner | E02D 5/56 248/219.3 |
| 7,744,316 | B2 * | 6/2010 | Kaufman | E02D 35/005 405/230 |
| 8,777,520 | B2 * | 7/2014 | Lin | E02D 5/523 405/230 |
| 9,506,214 | B1 * | 11/2016 | Kaufman | E02D 27/12 |
| 9,689,134 | B1 * | 6/2017 | Li | E02D 7/22 |
| 9,863,114 | B2 * | 1/2018 | Kaufman | E02D 5/24 |
| 10,024,019 | B1 * | 7/2018 | Hunter | E02D 5/526 |
| 10,294,623 | B2 * | 5/2019 | Kaufman | E02D 7/22 |
| 10,590,619 | B2 * | 3/2020 | Ronnkvist | B21K 1/06 |
| 10,662,608 | B2 * | 5/2020 | Kaufman | E02D 35/005 |
| 10,844,569 | B2 * | 11/2020 | Kaufman | E02D 27/48 |
| 2003/0159839 | A1 * | 8/2003 | Perko | E02D 5/56 172/100 |
| 2005/0100416 | A1 * | 5/2005 | Whitsett | E02D 5/38 405/233 |
| 2006/0269364 | A1 * | 11/2006 | May | E02D 7/22 405/232 |
| 2010/0143048 | A1 * | 6/2010 | Lin | E02D 5/801 405/244 |
| 2016/0186402 | A1 * | 6/2016 | Tomchesson | E02D 5/56 405/232 |
| 2016/0215470 | A1 * | 7/2016 | Reusing | E02D 5/56 |

* cited by examiner

APPARATUS AND METHOD FOR LIFTING BUILDING FOUNDATIONS

CROSS-REFERENCE TO RELATED APPLICATIONS

This application is a continuation of U.S. patent application Ser. No. 12/783,303 filed May 19, 2010 and now issued U.S. Pat. No. 10,662,608, which is a continuation of U.S. patent application Ser. No. 11/623,154 filed Jan. 15, 2007 and now issued U.S. Pat. No. 7,744,316, the complete disclosures of which are hereby incorporated by reference in its their entirety.

BACKGROUND OF THE INVENTION

Field of the Invention

The present invention relates generally to tools, equipment, and fixtures used in the building and construction trades, and more specifically to a system for lifting and/or stabilizing foundations and the like.

Related Art

As buildings age and settle there is sometimes a need for lifting or jacking the building foundation to make all parts of the building approximately level, which in turn repairs and prevents further damage to the building structure. There are numerous designs known in the art for systems for stabilizing and lifting building structures. These typically begin with a pier or piling driven or screwed into the ground beneath the building foundation, leaving a piling projecting upwards on which a lifting structure is attached. The lifting structure attaches to the piling and also to the building, with the lifting structure pushing against the piling to stabilize or raise the building.

Despite the variety of lifting systems currently available, these systems suffer from several drawbacks. The piers and pilings come in a variety of diameters, cross-sectional shapes, and lengths. At the lower end of the pier there is often attached a helical auger which helps to stabilize the pier, the augers vary in their diameter, pitch (i.e. angle of curvature), and number of turns. Thus it is necessary to keep in stock a large number of piers with helical augers attached in order to have at the ready a pier with the correct length shaft which also has the desired auger dimensions and shaft cross-sectional size and shape.

Furthermore, in some cases it is necessary to extend the length of a piling, for example when conditions are such that a pier is driven deeper into the ground than had been anticipated or provided for in advance. Thus there is a need for a way to extend the length of a piling while still maintaining adequate lifting strength.

Therefore, there is a need in the art to modularize pier and piling systems to reduce the number of parts that must be kept on hand while making assembly of pier systems easier.

There is also a need for keeping the lifting assembly closely attached to the building structure without slippage of the lifting assembly relative to the building structure.

Finally, there is a need for making the pilings sturdier and more rust-resistant.

The invention described below overcomes one or more of the above-described problems.

SUMMARY OF THE INVENTION

In one aspect the invention is a lift bracket system for lifting a building structure such as a foundation and the like comprising a lift plate having a top surface and a bottom surface, the top surface for insertion under the building structure; a generally cylindrical housing affixed to the lift plate and extending perpendicularly from the top surface and the bottom surface of the lift plate, the housing defining a generally circular opening through the lift plate, the opening being disposed away from the center of the lift plate; and at least one gusset for supporting the lift plate, the gusset having a first end and a second end, the gusset disposed beneath the lift plate, wherein the first end of the gusset is attached to the bottom surface of the lift plate and the second end of the gusset is attached to the housing.

In another aspect the invention is a support system for a building structure such as a foundation and the like comprising a pier disposed in the ground below the building structure to be supported, the pier comprising a support pile extending up toward the building structure; at least one extension piece, the extension piece having a first end and a second end, the first end having two pairs of holes therethrough and the second end having fixedly attached thereto a coupling, the coupling having two pairs of holes therethrough and being sized to receive a second pipe with generally mating holes, wherein the coupling is operably connected to the support pile; and a lift bracket operably connected to the extension piece.

In yet another aspect the invention is a method of lifting a building structure such as a foundation and the like comprising the steps of providing a pile anchored in the ground; affixing a lift bracket and a cap to the pile using a plurality of support bolts, the support bolts being attached to the cap with a plurality of nuts, wherein the lift bracket has a cylindrical housing; tightening each of the nuts to draw the lift bracket closer to the cap, thereby lifting the building; and attaching a bracket clamp to the lift bracket at a position determined by a preformed pair of holes in the lift bracket.

In still another aspect the invention is a modular foundation pier comprising a piling having a first cross-sectional size and a first cross-sectional shape; a sleeve having a second cross-sectional shape approximately the same as the first cross-sectional shape, the sleeve having a second cross-sectional size sufficiently larger than the first cross-sectional size so as to permit relative sliding of the sleeve along the piling; and a helical auger fixedly attached to the sleeve; wherein the sleeve is slid onto the piling and fixed thereto.

In another aspect the invention is an extension piece for a foundation pier comprising a shaft having a first end and a second end; a coupler attached to the first end of the shaft and having at least one pair of holes for receiving a fastener; and the second end of the shaft having at least one pair of holes for receiving a fastener.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
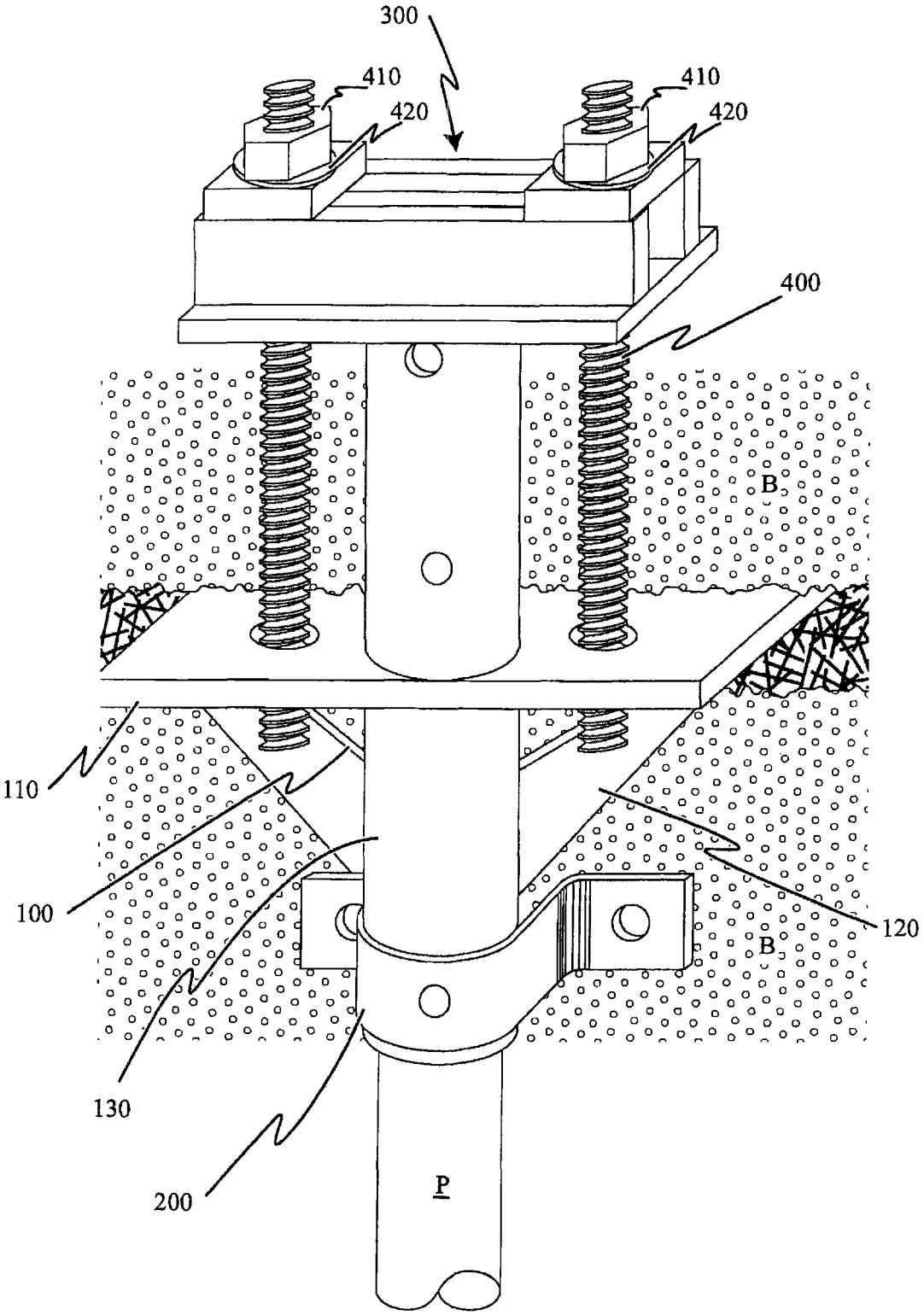
FIG. 1A shows a perspective view of one embodiment of the assembled lifting structure attached to a building structure.

The following description of the preferred embodiment(s) is merely exemplary in nature and is in no way intended to limit the invention, its application, or uses.

After determining how the building or other structure needs to be lifted or supported, piles or pipes (hereinafter collectively referred to as a "pile" or "piles") P attached to foundation piers or the like are set into the ground near the structure using known methods. The piers typically consist of a long shaft driven into the ground, upon which a lifting assembly is assembled. The shaft of the pier may include one or more lateral projections such as a helical auger to provide further support for the pier by providing a larger surface area. In some cases one or more extension pieces may be attached to the pier to extend it to the height of the building or to adapt a pile with a non-circular cross-section to a circular cross-section, as discussed below. The lifting assembly (FIGS. 1A, 1B) is then attached to the top end of pile P. If pile P is not long enough to allow the lifting assembly to interact properly with a foundation or other building structure B, one or more extension pieces (FIG. 2A; described below) can be added to pile P to adjust it to the correct length. Alternatively, if pile P is too long to permit proper assembly of the lifting assembly as described herein, then part of pile P can be removed using methods including, but not limited to, conventional cutting techniques. As another alternative, if extension pieces have been employed, as described below, then switching to a different length extension piece can be used as a method to adjust pile P to an advantageous elevation.

Support piles can come in various cross-sections including square or circular, and each cross-section can come in different diameters. Where the piling has attached to it a helical auger at its lower end (FIG. 2D), a large number of different pilings typically need to be kept in stock in order to have available every possible combination of cross-sectional shape and diameters with a variety of lengths as well as differing diameters of the helical auger portion. To eliminate this costly and burdensome practice, one embodiment of the present invention provides for a modular piling collar 700, which consists of a sleeve 710 and a helical auger portion 720 that can be slid onto a piling shaft 730 and secured into place, for example with bolts. Helical auger portion 720 is firmly attached to sleeve 710, preferably by welding. Modular piling collar 700 is made with sleeves of various cross sections and diameters and having helical augers with various diameters, pitches, and numbers of turns of the auger (FIGS. 2E, 2F). In one embodiment sleeve 710 has one or more pairs of holes 740 for attaching modular piling collar 700 onto piling shaft 730, preferably with bolts. In a preferred embodiment there are two pairs of holes 740 which are aligned to accept orthogonally-disposed fasteners. To make a pier with a particular length one merely slides the appropriate modular piling collar onto a piling shaft of the desired length and affixes the modular piling collar in place. A preferred method for affixing the modular piling collar onto the piling shaft is by drilling mating holes in the piling shaft to match those on the sleeve and using fasteners such as bolts to hold the sleeve onto the piling shaft. In one embodiment the end of piling shaft 730 has a beveled tip 750 to better penetrate the ground during installation of the pier (FIG. 2D).

In the case where a pier with a non-circular piling shaft is employed, this can nonetheless be adapted for use with the lift bracket of the present invention, the lift bracket being described in further detail below. To adapt from a non-circular (e.g. square) to a circular piling shaft, a circular piling PI with an inside diameter at least as large as the largest cross-sectional dimension of the non-circular shaft is slid over the non-circular shaft 730 A (FIG. 2G). One or more sets of mating holes are drilled through the circular and non-circular shafts in the region where the shafts overlap and fasteners such as bolts B 10 are inserted through the holes to secure the shafts together. The lift bracket can then be slid onto the circular shaft as described further below.

The support pile extension piece 10 (FIG. 2A) comprises a variable-length shaft or body portion 20 comprising a length of pipe or other similar material, which in one embodiment is made from a metal such as iron. The extension piece body portion 20 in a preferred embodiment is of the same dimensions as the support pile to which it is attached, which in one embodiment is an outside diameter of 3.5 inches. The cross-sectional shape of extension piece 10 can be circular, square, hexagonal, or any other shape, although in preferred embodiments it is circular or square. The extension piece body portion 20 can be made to different lengths as the application requires. The first end of the extension piece body portion 20 has one or more pairs of holes 30 in it to allow for joining of adjacent pieces. If there is more than one pair of holes, as is the case in the preferred embodiment, the pairs of holes 30 are offset from one another along the long axis of the extension piece body portion 20. In one embodiment the pairs of holes 30 are two inches apart and the first pair is two inches from the first end. The two members of each pair are on opposite sides of the pile, such that a fastener extending through holes 30 will be generally perpendicular to the long axis of the extension piece and will enter and leave the extension piece body portion 20 approximately normal to the surface. In a preferred embodiment the first end has two pairs of holes 30, which are preferably rotationally offset from one another by 90° such that fasteners 45 inserted into the holes are perpendicular to one another when extension piece 10 is viewed in cross-section (FIG. 2B).

Figure 2A:
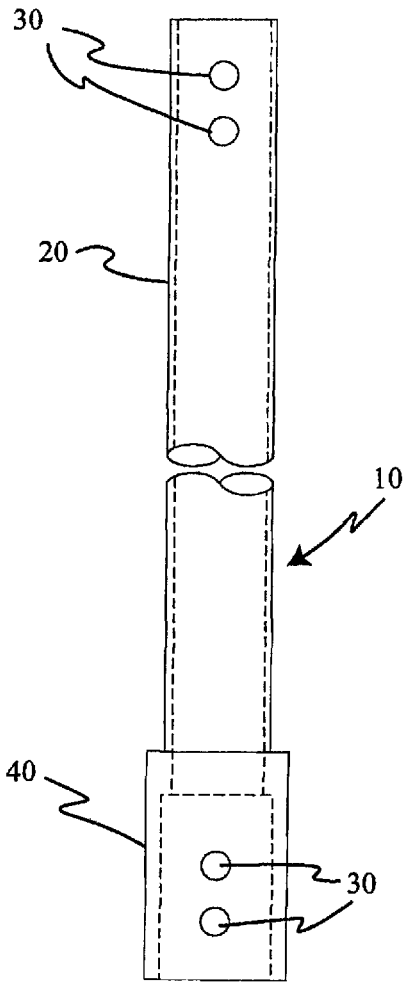
FIG. 2A shows a side view of an extension piece with its associated connector piece.
Figure 2B:
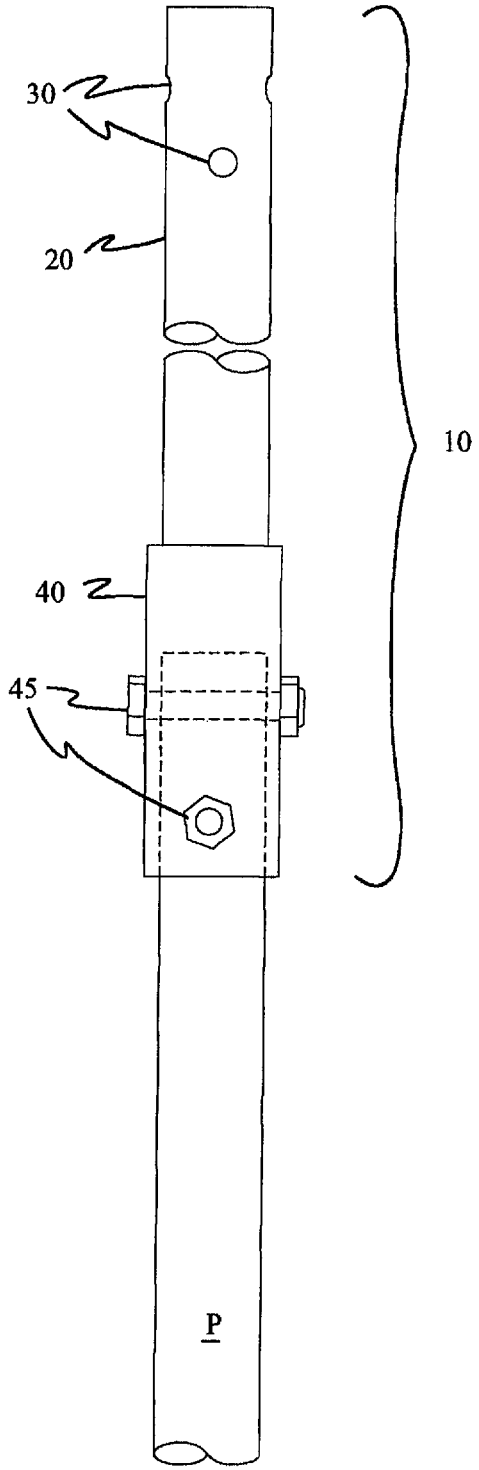
FIG. 2B shows a side view of a preferred embodiment of the extension piece attached to a pile by means of two perpendicularly situated fasteners.

The second end of extension piece 10 comprises a coupler or connector piece 40 attached to the second end of the body portion 20 (FIG. 2A). Connector piece 40 is preferably externally disposed (although internally-disposed connectors are also encompassed within the invention) with an inside diameter that is large enough to accommodate the outside diameter of the adjacent pile or extension piece to which it is attached. Connector piece 40 in this embodiment is preferably made from a piece of pipe having a larger diameter than the main body of the extension piece and is attached to the extension piece body portion 20 in a fixed manner, such as by welding. Connector piece 40 has one or more holes 30 that mate with those on the adjacent pile or extension piece, such as those described above for the first end of the extension piece. In a preferred embodiment there are two pairs of holes, offset from one another along the long axis of the connector piece and offset by 90° rotationally, as described above (FIG. 2B). In one embodiment connector piece 40 is eight inches long and the pairs of holes 30 are two inches apart and one such pair is two inches from the end of connector piece 40 that is distal to body portion 20 itself. Extension piece 10 is joined to an adjacent extension piece or to a pile P by inserting fasteners, such as bolts, through the substantially mating pairs of holes of the adjoining components, as are described above (FIG. 2B). Holes 30 at both ends of extension piece 10 are, in a preferred embodiment, 15/16ths inches in diameter. Holes of a similar size and location so as to mate with those on extension piece 10 must be made in pile P, either in advance or at the job site.

Figure 2C:
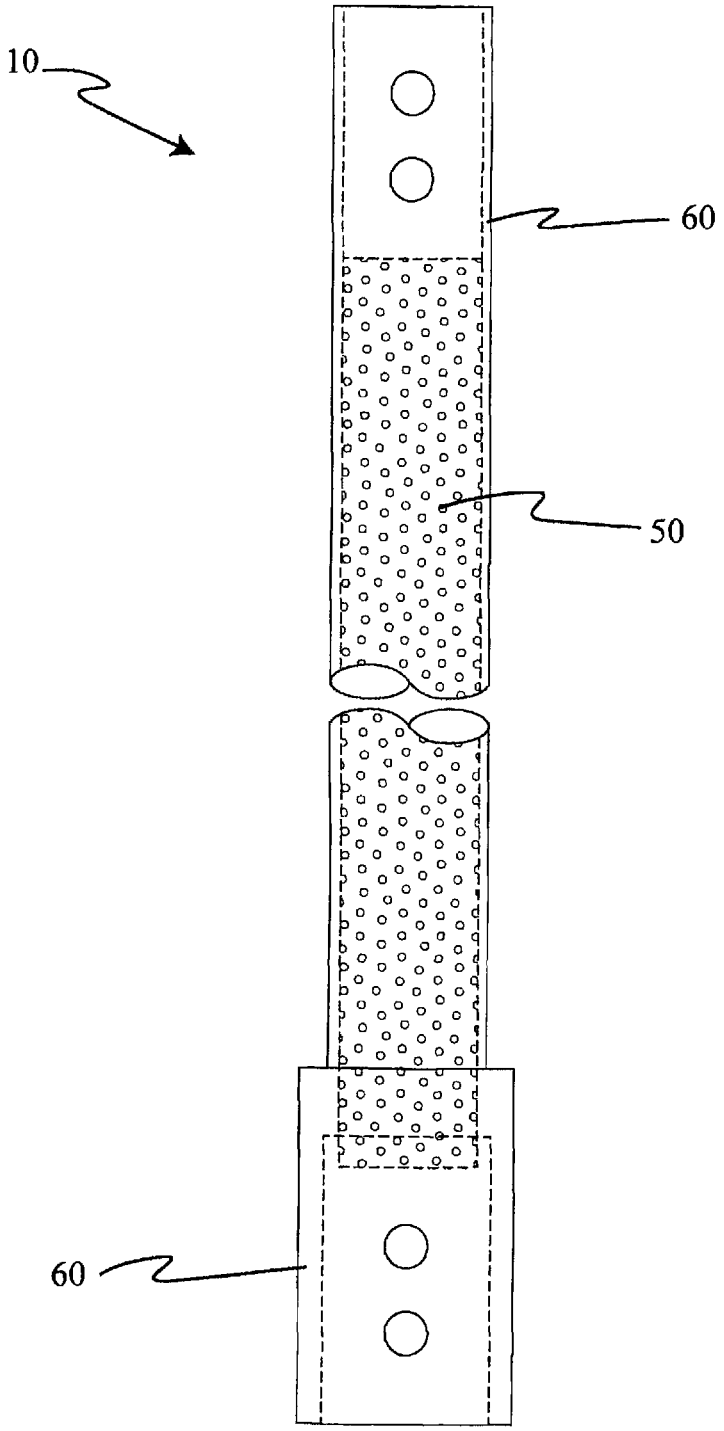
FIG. 2C shows a side view of an embodiment of the extension piece with a connector attached at one end.
Figure 2D:
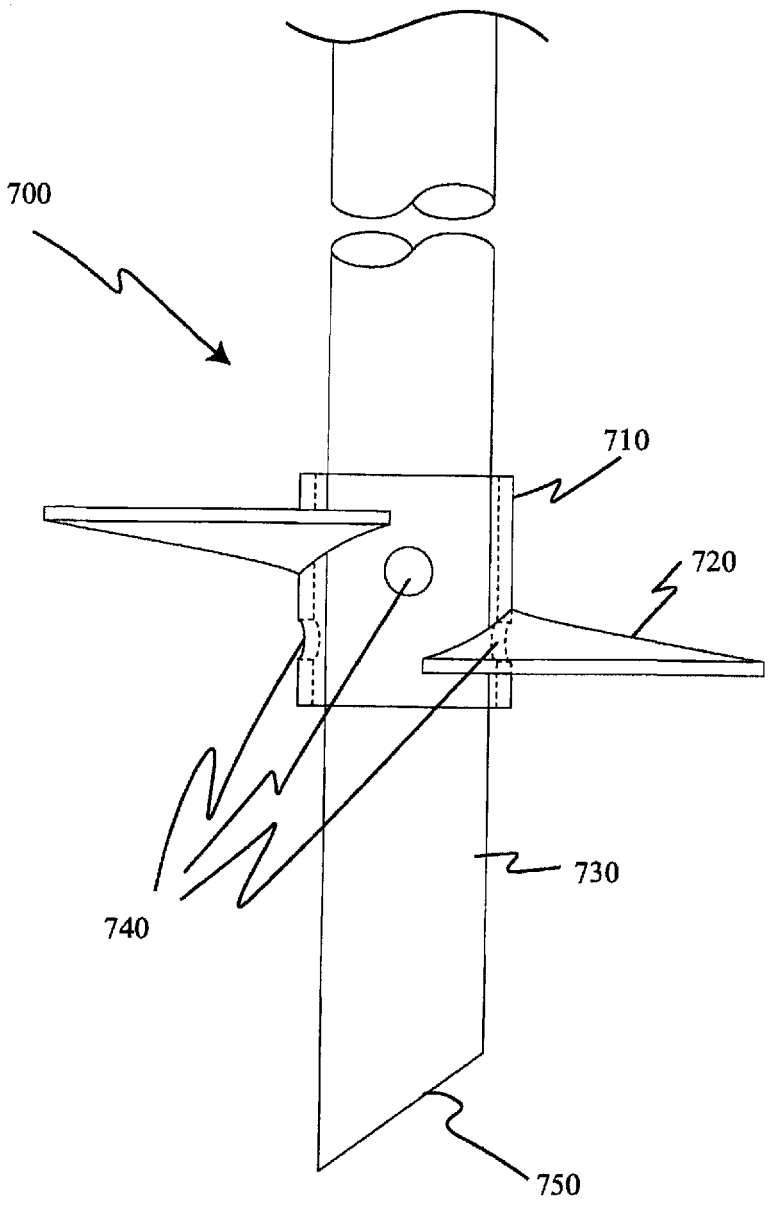
FIG. 2D shows a side view of an embodiment of the present invention in which a modular piling collar with a helical auger attached thereto is attached to a piling shaft.
Figure 2E:
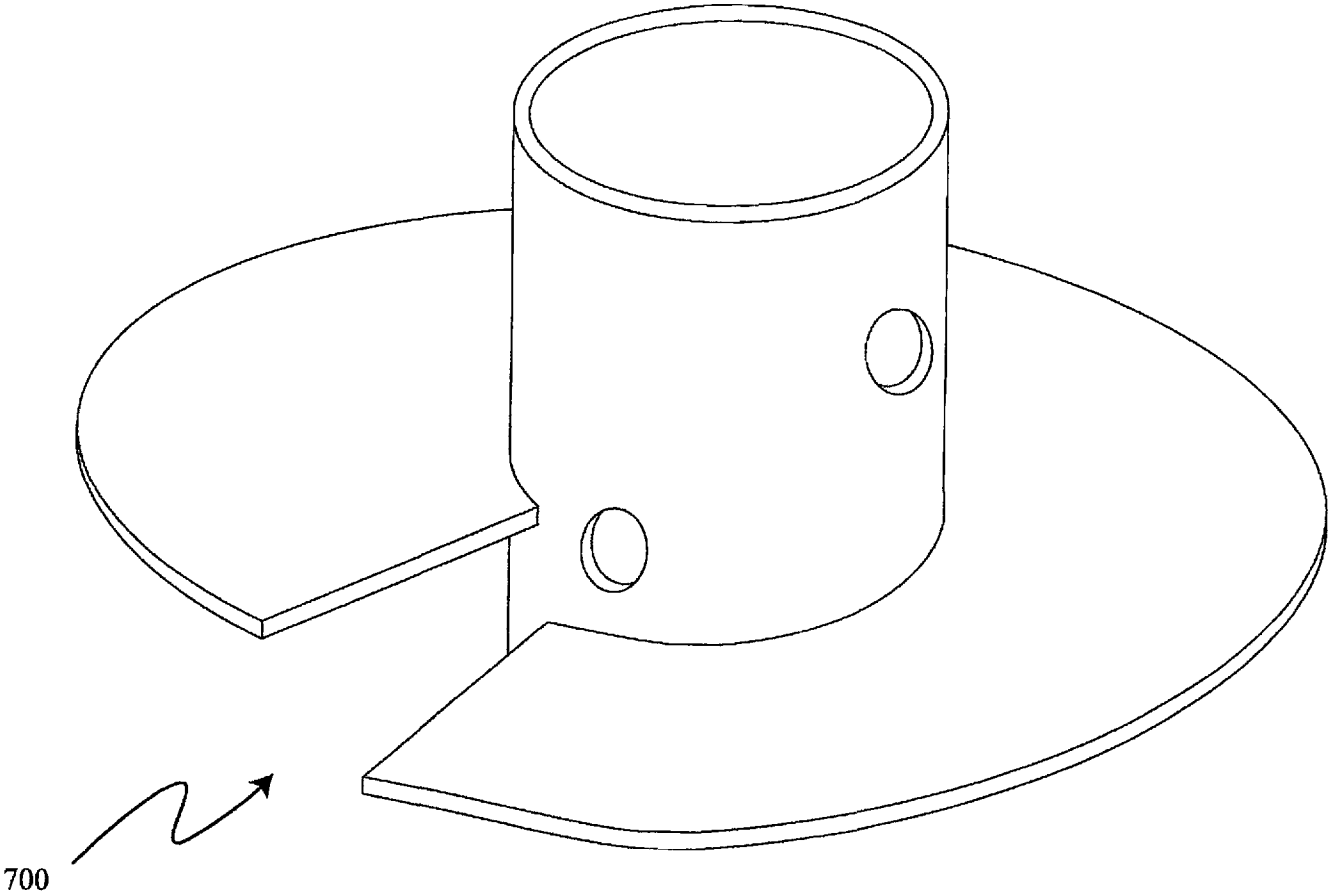
FIG. 2E shows a perspective view of a modular piling collar for pilings having a circular cross section.
Figure 2F:
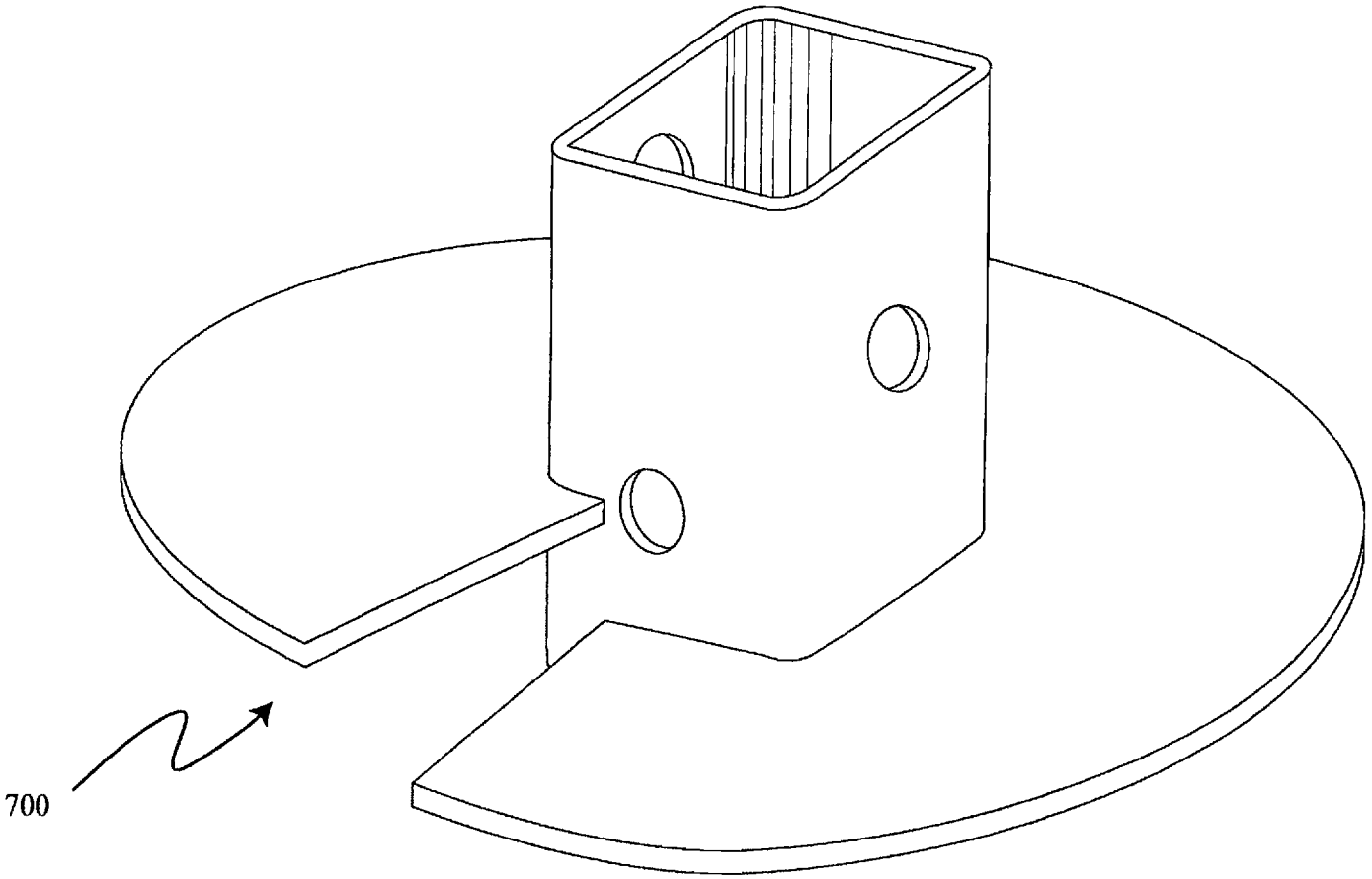
FIG. 2F shows a perspective view of a modular piling collar for pilings having a square cross section.
Figure 2G:
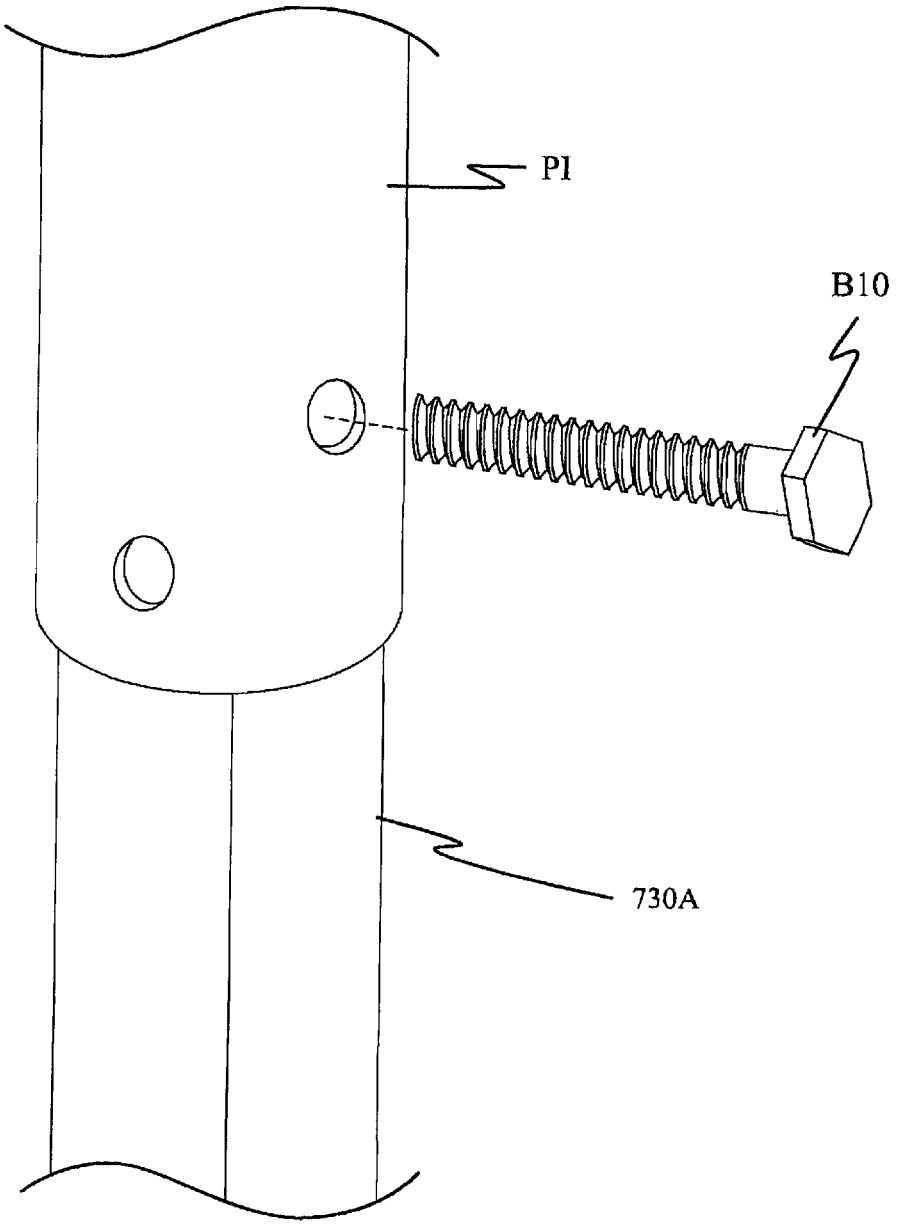
FIG. 2G shows a perspective view of a piling with a circular shaft attached to a piling with a square shaft using fasteners inserted into pairs of mating holes.

In one embodiment the extension piece(s) and/or pile are filled with what is preferably a non-metallic substance such as light concrete or chemical grout 50 (FIG. 2C). The addition of filler to the extension pieces helps to strengthen the pieces and, by excluding water from the insides, makes them more rust-resistant. The piles and/or extension pieces can be filled ahead of time (leaving space open for the pieces to couple and for the fasteners to enter) or can be filled after assembly at the job site by inserting filler material into the piles or extension pieces, including into access hole 60 (FIG. 2C). If the extension pieces have been prefilled except near the pairs of holes where the fasteners go through, then the remaining space can be filled after assembly by inserting additional filler material into access hole 60 (FIG. 2C). Access hole 60 is situated on the side of connector piece 40 with a substantially mating access hole 60 being present at the end of extension piece 10.

When support pile P, or a pile plus extension piece(s), has been assembled and adjusted to the correct height relative to the building or other structure, the lifting assembly can be slid onto the pile or extension piece P (for simplicity, hereinafter "pile P" refers to either the pile itself or any extension piece or pieces added onto the pile and to which the lifting assembly is attached, unless stated otherwise).

The lifting assembly (FIG. 1A) in a preferred embodiment comprises a bracket body 100, one or more bracket clamps 200 and accompanying fasteners, a slider block 300, and one or more supporting bolts 400 (comprising allthread rods, for example) and accompanying hardware. In another embodiment (FIGS. 1B, 7) the lifting assembly includes all of the above components as well as a jacking block 500 and a jack 600.

Figure 3:
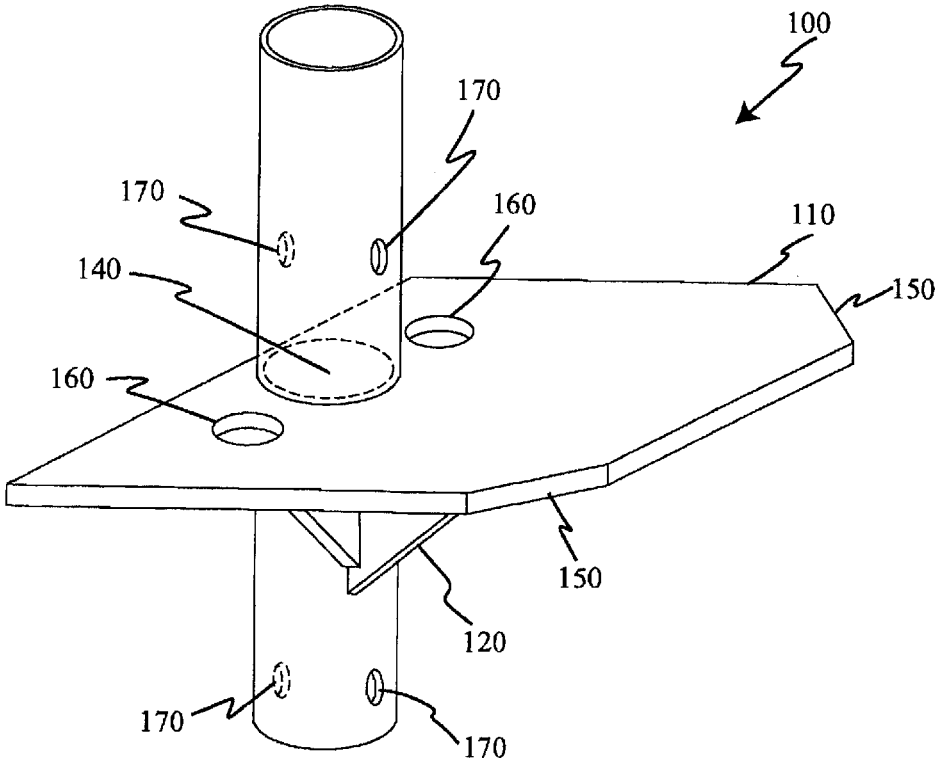
FIG. 3 shows a perspective view of a bracket body.

The bracket body 100 comprises a generally flat lift plate 110, one or more optional gussets 120, and a generally cylindrical housing 130 (FIG. 3). The lift plate has a top surface and a bottom surface, where the top surface is inserted under and interacts with the building, foundation or other structure that is to be lifted or supported. Lift plate 110 includes a large hole 140, preferably off-center, with which cylindrical housing 130 is aligned and to accommodate pile P. The corners 150 of lift plate 110 that are further from large hole 140 are preferably rounded or chamfered, to make it easier to rotate the bracket body into position under the building structure. Cylindrical housing 130 runs generally perpendicular to the surface of lift plate 110 and extends above and below the plane of lift plate 110. In one embodiment cylindrical housing 130 extends eight inches above and eight inches below the plane of lift plate 110. Cylindrical housing 130 can be made of either a single cylindrical piece of pipe or other material that extends through the lift plate, or alternatively can be made of two separate pieces that are attached to the top and bottom surfaces of lift plate 110, respectively, and are aligned with large hole 140.

In a preferred embodiment one or more gussets 120 are attached to the bottom surface of lift plate 110 as well as to the lower portion of cylindrical housing 130, to increase the holding strength of lift plate 110. In a preferred embodiment, gussets 120 are attached to cylindrical housing 130 by welding, although other secure means of attachment are encompassed within this invention.

In addition to large hole 140 for accommodating pile P, lift plate 110 has one or more small holes 160 sized to accommodate support bolts 400. Cylindrical housing 130 has one or more pairs of holes 170 to accommodate fasteners (not shown), as described below. The pairs of holes 170 in cylindrical housing 130 are on opposite sides of the housing and are oriented normal to the surface of the housing, such that a fastener extending through the holes is perpendicular to the long axis of cylindrical housing 130 and extends towards building structure B when lift plate 110 is inserted under building structure B.

Figure 4:
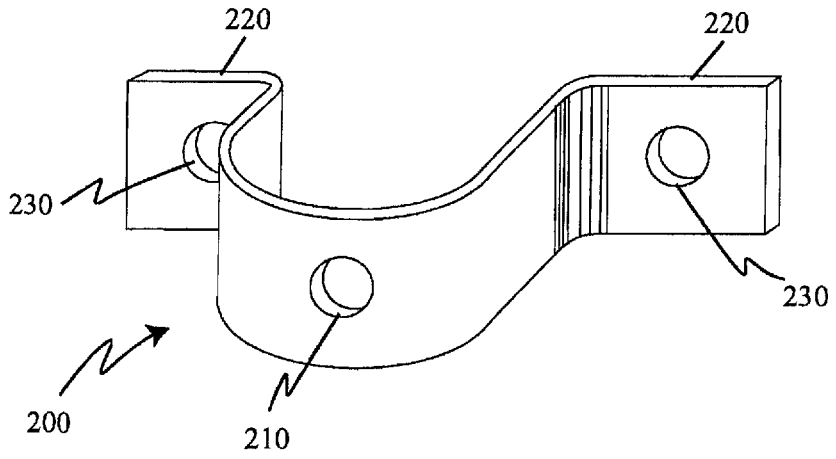
FIG. 4 shows a perspective view of a bracket clamp.

Bracket clamps 200 (FIG. 4), in one embodiment, comprise a generally L)-shaped piece having a center hole 210 at the apex of the "Li" to accommodate a fastener (not shown). The ends of the a-shaped bracket clamp have ears or lugs 220 preferably extending laterally, which themselves have holes 230 to accommodate fasteners (not shown). The fasteners extending through holes 230 in lugs 220 are attached to the building structure, while the fastener extending through center hole 210 at the apex of the "a" extends into one of holes 170 in cylindrical housing 130. In one embodiment the fastener extending through center hole 210 in bracket clamp 200 and into cylindrical housing 130 further extends through pile P and into hole 170 on the opposite side of cylindrical housing 130, and in one embodiment this fastener then anchors into the building structure. In embodiments where the fastener extends into pile P (with or without a bracket clamp), a hole or holes are made in pile P to accommodate the fastener, using known methods. In such cases, however, the fastener is not inserted through pile P until jacking or lifting has been completed, since bracket body 100 must be able to move relative to pile P in order to effect lifting of the building structure.

The lift assembly may have one or more of the above-described bracket clamps 200. Bracket clamps 200 are attached above (FIG. 1B) and/or below (FIGS. 1A, 7) lift plate 110, depending on the structure to be lifted. Bracket clamps 200 are attached to cylindrical housing 130 at predetermined, nonadjustable points, where pairs of holes 170 have previously been made in cylindrical housing 130.

Bracket body 100 is placed onto pile P with the larger portion of lift plate 110 facing away from the building structure. When bracket body 100 is at the desired elevation relative to the building structure, bracket body 100 is rotated until lift plate 110 is securely under the building structure. At this point one or more bracket clamps 200, as described above, can be attached to bracket body 100 at the predetermined locations which are dictated by the locations of pairs of holes 170 in cylindrical housing 130. Also at this time bracket clamps 200 are secured into building structure B, since it is desired that during the lifting process bracket body 100 should remain fixed relative to the building structure (FIGS. 1A, 1B).

Figure 1B:
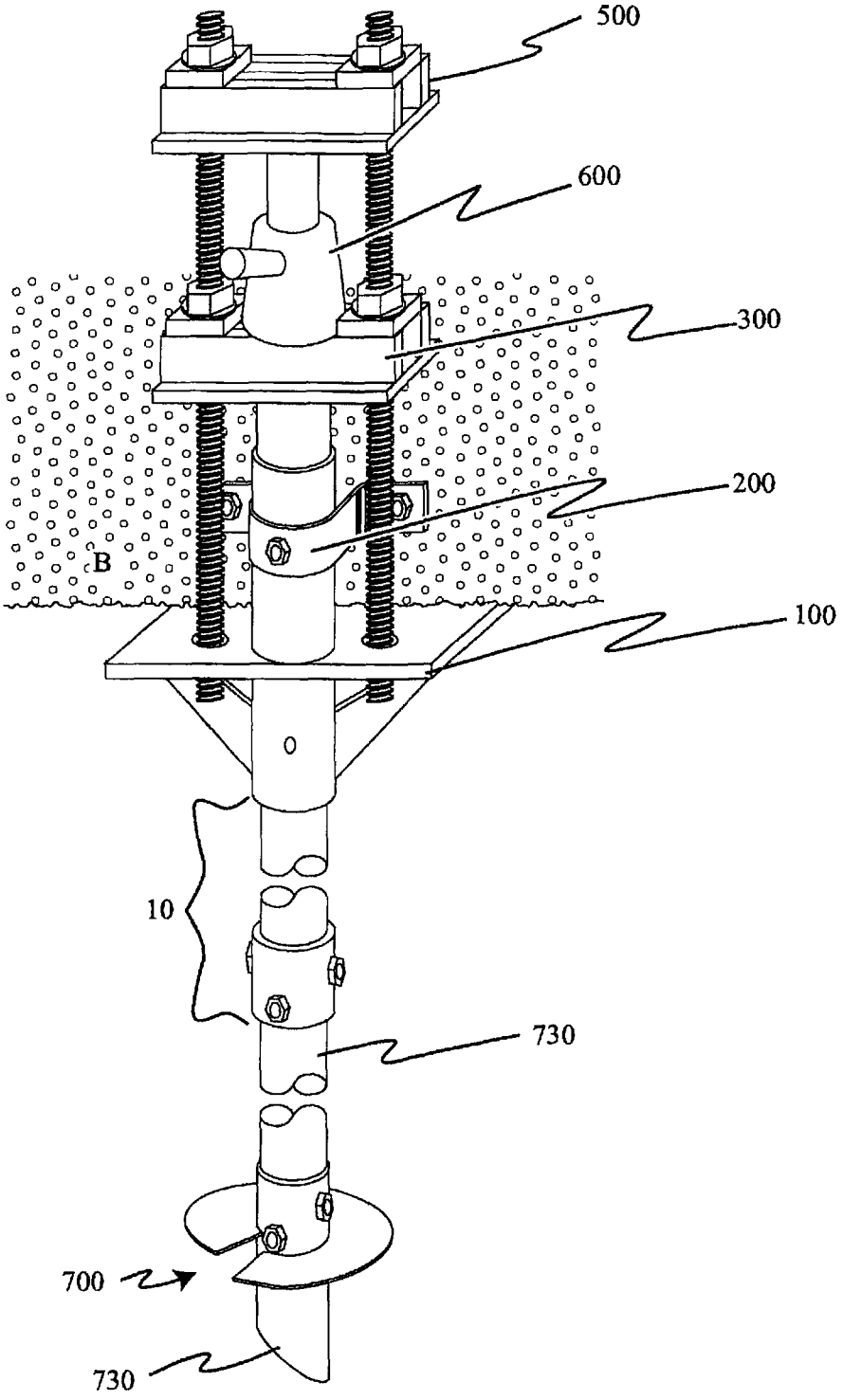
FIG. 1B shows a complete assembly of a pier with modular piling collar, piling, extension piece, and lift bracket according to the present invention, with the bracket clamp positioned above the lift plate.
Figure 5A:
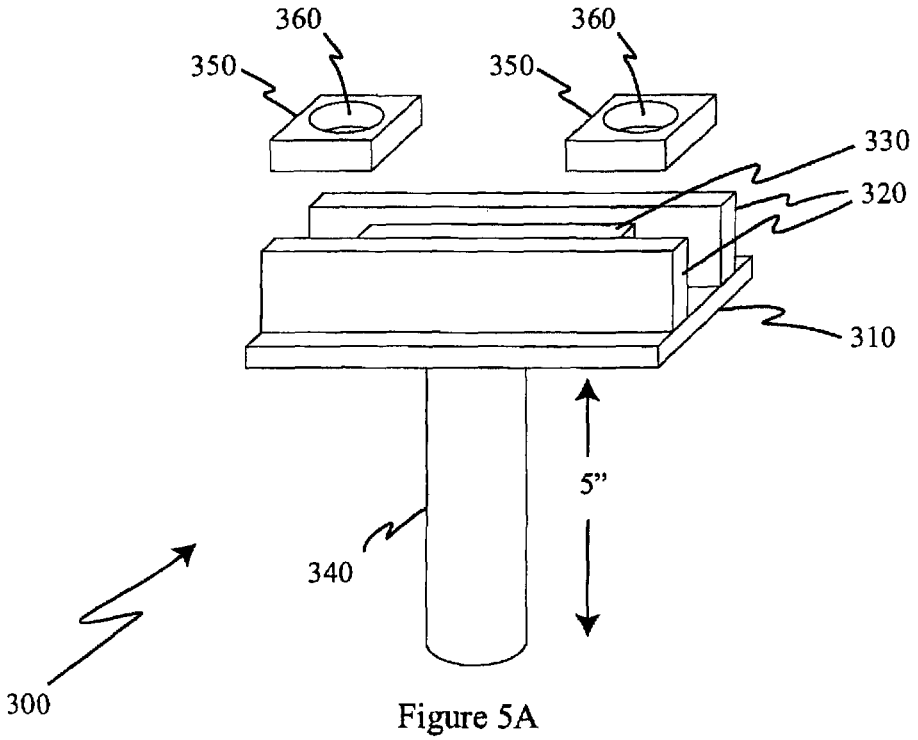
FIG. 5A shows a perspective view of a slider block with its associated bolt support pieces.
Figure 5B:
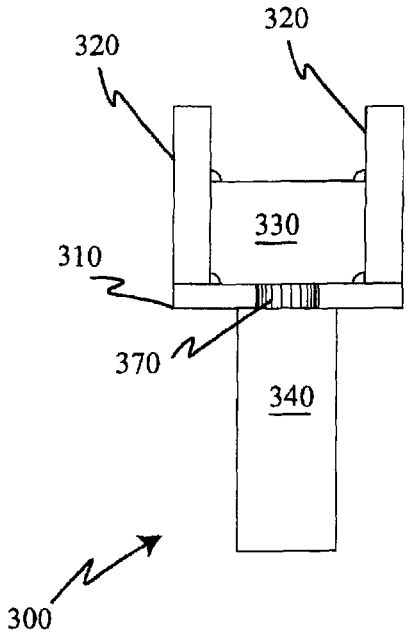
FIG. 5B shows a side view of a slider block.
Figure 5C:
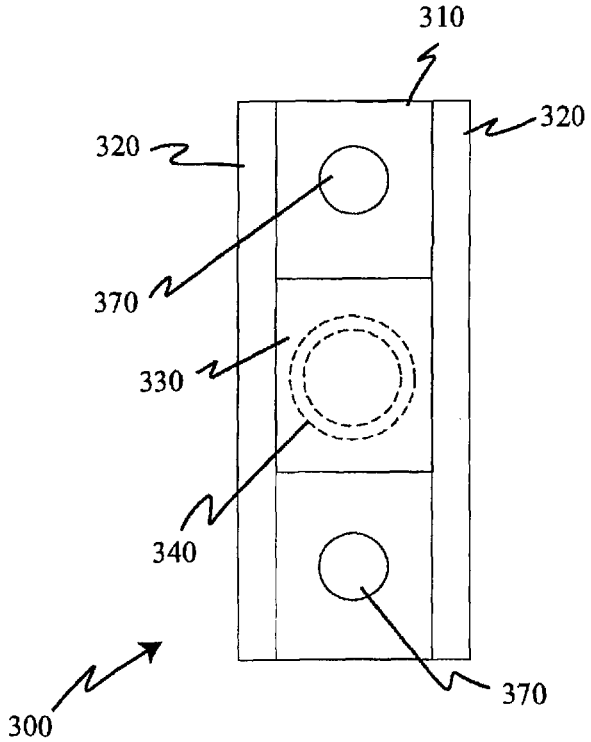
FIG. 5C shows a top view of a slider block.

After adjusting the position of bracket body 100, slider block (or "t-cap", or "cap") 300 is placed on top of bracket body 100 (FIGS. 1A, 1B). Slider block 300 comprises one or more flat base plates 310, one or more side plates 320, one or more center plates 330, a support pipe 340, and one or more bolt support pieces 350. In a preferred embodiment slider block 300 comprises one base plate 310, two side plates 320, one center plate 330, one support pipe 340, and two support pieces 350 (FIGS. 5A-5C). Support pieces 350 are preferably square or rectangular and are large enough to overlap with both side plates 320, when side plates 320 are configured as described below, and having a hole 360 sized to accommodate a support bolt 400. Base plate 310 is preferably flat and rectangular and has one or more (preferably two) holes 370 for accommodating the support bolts (FIG. 5C). Support pipe 340 is attached approximately in the center of the bottom surface of base plate 310. Side plates 320, which are preferably flat and rectangular, are oriented on their narrower edges with their long axes parallel to the long axis of base plate 310. Center plate 330, which is preferably the shape of a squat rectangular block, is disposed between side plates 320 and is in substantial contact with side plates 320 and base plate 310, such that center plate 330 holds side plates 320 stably on their narrower edges. The long axis of center plate 330 is shorter than that of base plate 310, so that center plate 330 does not obstruct any of holes 370 in base plate 310. Holes 370 in base plate 310 are spaced to match the center-to-center distance(s) of holes 160 in bracket body 100. All of the components of slider block 300 are preferably metal and, except for support pieces 350, are rigidly attached to one another, for example by welding. Support pipe 340 extending from the bottom surface of base plate 310 of slider block 300 is sized to mate with the inside of cylindrical housing 130 of bracket body 100 and has generally the same outside diameter as that of pile P.

The length of pile P must be adjusted, as previously mentioned, so that the top end of pile P terminates within cylindrical housing 130. When slider block 300 is placed on top of bracket body 100, the end of support pipe 340 of slider block 300 should touch the top end of pile P. It is preferred that the respective ends of support pipe 340 and pile P meet squarely and with as much surface contact as possible, since it is the pushing of support pipe 340 against pile P that leads to lifting of the building structure. It is preferred that the distance between the bottom surface of base plate 310 of slider block 300 and the top of cylindrical housing 130 of bracket body 100 be greater than or equal to the total anticipated lifting distance required. When the bottom of base plate 310 of slider block 300 makes contact with the top of cylindrical housing 130 of bracket body 100 then no more lifting can occur since slider block 300 can no longer move relative to bracket body 100.

After slider block 300 and bracket body 100 are in place, support bolts 400 are assembled (FIGS. 1A, 1B). At their top ends the support bolts extend through the holes in the slider block and are held in place by a mating nut 410 and an optional washer 420. Nut 410 and washer 420 are held in place on top of slider block 300 by inserting therebetween on each bolt 400 a support piece 350. Support piece 350 rests on the top edges of side plates 320 of slider block 300. Support pieces 350 serve to keep nuts 410 above and out of the channel between side pieces 320 so that nuts 410 are accessible and can be turned more readily. The lower ends of support bolts 400 extend through small holes 160 in lift plate 110 of bracket body 100 and are held in place by mating nuts 410 and optional washers 420 attached on the ends of bolts 400 extending through the bottom surface of lift plate 110.

Although the preferred embodiment described herein uses two supporting bolts 400, the invention encompasses any number of such bolts.

In one embodiment bracket body 100 is raised by tightening nuts 410 attached to the top ends of supporting bolts 400. In a preferred embodiment nuts 410 are tightened simultaneously, or alternately in succession in small increments with each step, so that the tension on bolts 400 is kept roughly equal throughout the lifting process. Use of this method allows the weight supported by bracket body 100 to be transferred equally between each of bolts 400 to prevent over-stressing one of bolts 400. Also, maintaining equal tension assures that, in the preferred embodiment with two bolts 400, bracket body 100 remains substantially level and does not cant or tilt during the lifting process. Such canting or tilting could cause support pipe 340 or pile P inside cylindrical housing 130 to bind, thereby inhibiting the sliding motion relative to cylindrical housing 130 that is required during the lifting process.

Figure 7:
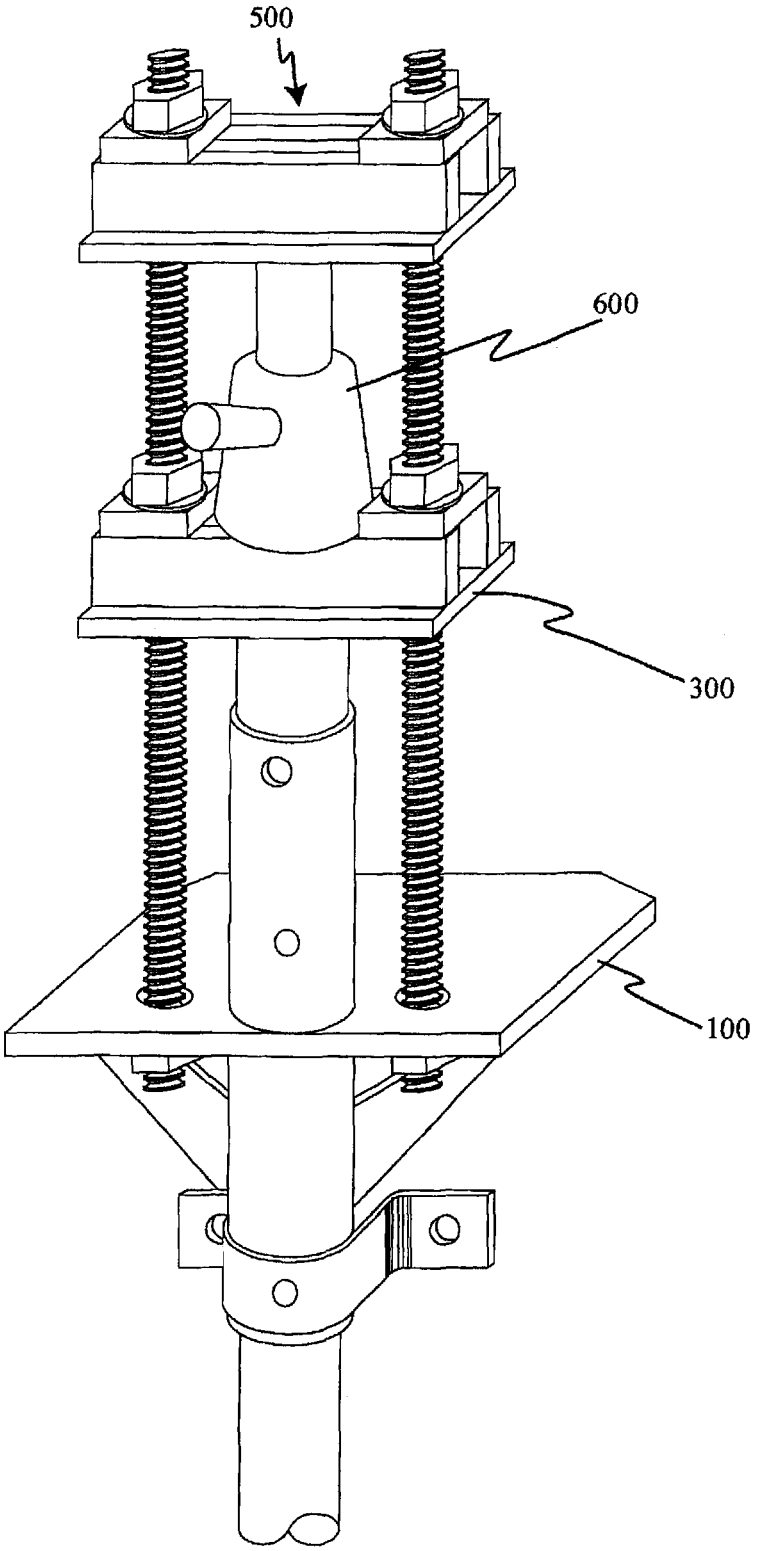
FIG. 7 shows a perspective view of another embodiment of the assembled lifting structure.

An alternative embodiment allows a jack to be used to effect lifting of bracket body 100. In this embodiment longer support bolts 400 are provided and are configured to extend high enough above slider block 300 to accommodate: a jack 600 resting on slider block 300, a jacking block 500, plus the combined thickness of a support piece 350 along with a nut 410 and an optional washer 420 (FIG. 7).

Figure 6A:
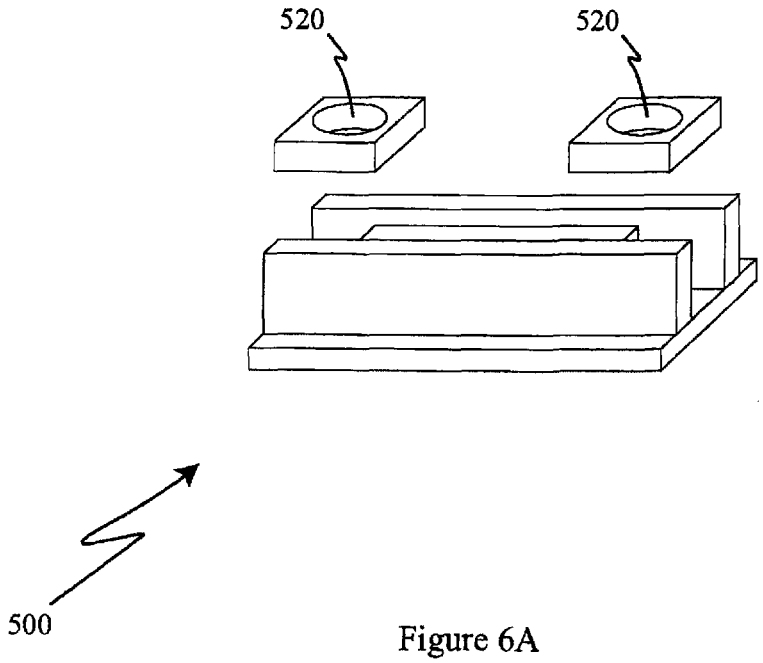
FIG. 6A shows a perspective view of a jacking block with its associated bolt support pieces.
Figure 6B:
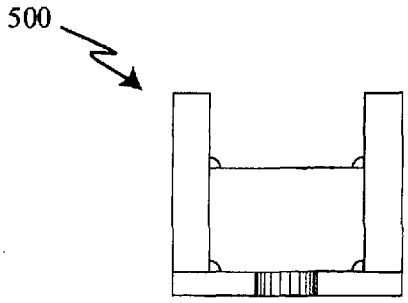
FIG. 6B shows a side view of a jacking block.
Figure 6C:
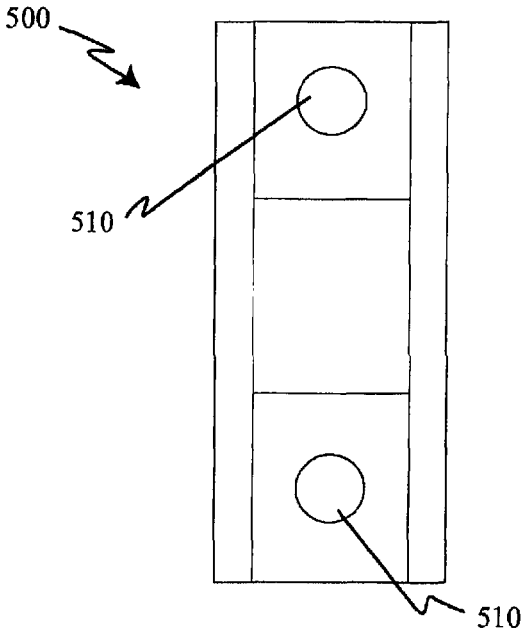
FIG. 6C shows a top view of a jacking block.

Jacking block 500 is similar to slider block 300 except that jacking block 500 does not have a support pipe extending from its underside (FIGS. 6A-6C). Jacking block 500 has one or more holes 510 similar in size and location to those of slider block 300 and bracket body 100 to accommodate support bolts 400 (FIG. 6C). To accommodate jacking block 500 an assembly is constructed as described above with bracket body 100 positioned on pile P, lift plate 110 inserted under the building structure, slider block 300 inserted on top of bracket body 100, and support bolts 400 attached with a portion extending above slider block 300. A jack 600 is then placed atop slider block 300 and jacking block 500 is thereafter positioned on top of jack 600, with support bolts 400 extending through holes 510 of jacking block 500. Support pieces 520, nuts 410, and optional washers 420 are then put onto the ends of bolts 400 and tightened with approximately equal tension placed on each nut 420. As with the previous lifting embodiment, the distance between the bottom of slider block 300 and the top of cylindrical housing 130 must be at least the same as the distance that it is anticipated the building structure needs to be lifted.

When all of the components are in place and sufficiently tightened, jack 600 (of any type, although a hydraulic jack is preferred) is activated so as to lift jacking plate 500. As jacking plate 500 is lifted, force is transferred from jacking plate 500 to support bolts 400 and in turn to lift plate 110 of bracket body 100. When the building structure has been lifted to the desired elevation, nuts 410 immediately above slider block 300 (which are raised along with support bolts 400 during jacking) are tightened down, with approximately equal tension placed on each nut 410. At this point jack 600 can then be lowered while bracket body 100 will be held at the correct elevation by the tightened nuts 410 on slider block 300. Jacking block 500 can then be removed and reused. The extra support bolt material above nuts 410 at slider block 300 can be removed as well, using conventional cutting techniques.

To help solidify the structure one or more bracket clamps 200 can be attached, if this has not already been done, or additional bracket clamps 200 may added. Bracket clamps 200 are aligned with the pairs of holes 170 on the cylindrical housing 130 and are anchored into building structure B using fasteners inserted through the ears or lugs 220. An additional fastener is then inserted into center hole 210 in the apex of the )-shaped portion of bracket clamp 200. This fastener is optionally driven through pile P or support pipe 340 (depending on where the pairs of holes are situated and depending on how far into the cylindrical housing support pipe 340 runs) and into the opposite side of cylindrical housing 130 and optionally into the building structure. If necessary a hole is made in the portion of pile P or support pipe 340 that is inside cylindrical housing 130 to accommodate the fastener.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A support system for a building foundation comprising:

a support pile including a helical auger to be rotatably driven into the ground and stabilize the support pile in the ground in order to support the building foundation;

wherein the support pile includes a distal end opposite the helical auger, and the distal end including a first pair of holes disposed on opposite sides of the distal end and a second pair of holes disposed on opposite sides of the distal end, the first pair of holes and the second pair of holes being rotationally offset from one another to respectively accept first and second crossing fasteners extending completely through and between the first pair of holes and extending completely through and between the second pair of holes to establish a torque transmitting connection between the support pile and a support pile extension while the helical auger is rotatably driven into the ground.

2. The support system of claim 1, wherein the first pair of holes and the second pair of holes in the distal end are rotationally offset by 90°.

3. The support system of claim 1, wherein the distal end has a circular cross section or a square cross section.

4. The support system of claim 1, wherein the support pile is filled with a light concrete or chemical grout.

5. The support system of claim 1, further comprising a lift bracket.

6. The support system of claim 1, wherein the distal end has a polygonal cross section.

7. The support system of claim 6, wherein the first and second pair of fastener holes are formed through the polygonal cross section.

8. A support system for a building foundation comprising:

a first support pile including a metal shaft and a metal helical auger projecting outwardly from a circumference of the metal shaft and being configured to be rotatably driven into the ground; and a metal coupler attached to the first support pile, the metal coupler including a bolt hole to complete a bolted torque transmitting connection between the first support pile and a second support pile to rotatably drive the metal helical auger into the ground;

wherein the metal helical auger stabilizes the support pile below the ground in order to support the building foundation; and wherein the metal shaft has a first cross section and wherein the metal coupler has a second cross section, one of the first and second cross sections being round and the other of the first and second cross sections being non-round.

9. The support system of claim 8, wherein the second cross section is a polygonal cross section.

10. The support system of claim 9, wherein the polygonal cross section is one of a square cross section or a hexagonal cross section.

11. The support system of claim 10, wherein a bolt extends through and between the pair of bolt holes.

12. The support system of claim 9, wherein a pair of bolt holes are formed through the polygonal cross section to complete the bolted torque transmitting connection.

13. The support system of claim 9, wherein a circumference of the coupler is greater than the circumference of the metal shaft.

14. The support system of claim 13, wherein a circumference of the helical auger is greater than a circumference of the coupler.

15. The support system of claim 8, wherein the first cross section is round.

16. A support system for a building foundation comprising:

first and second support piles; and a coupler fixedly attached to an end of the first support pile, the coupler including a bolt hole to complete a bolted torque transmitting connection between the end of the first support pile and the second support pile to rotatably drive the first support pile into the ground via an application of torque on the second support pile;

wherein the coupler has a round outer surface; and wherein a distal end of the second support pile has a non-round outer surface, the non-round outer surface being received in the coupler.

17. The support system of claim 16, wherein at least one of the first and second support piles is provided with a helical auger.

18. The support system of claim 16, wherein the non-round outer surface is one of a square outer surface or a hexagonal outer surface.

19. The support system of claim 16, wherein a pair of bolt holes are formed through the non-round outer surface to complete the bolted torque transmitting connection.

20. The support system of claim 19, wherein a bolt extends through and between the pair of bolt holes.

* * * * *